United States Patent [19]

Pareja

[11] Patent Number: 4,830,589

[45] Date of Patent: May 16, 1989

[54] VARIABLE STROKE POSITIVE DISPLACEMENT PUMP

[75] Inventor: Ramon Pareja, Edina, Minn.

[73] Assignee: Hypro Corp., St. Paul, Minn.

[21] Appl. No.: 241,461

[22] Filed: Sep. 8, 1988

[51] Int. Cl.[4] ..... F04B 13/00

[52] U.S. Cl. ..... 417/539; 417/221; 417/216; 92/13.7

[58] Field of Search ..... 417/539, 221, 216; 123/48 B, 78 E, 78 F; 92/12.1, 13, 13.7

[56] References Cited

U.S. PATENT DOCUMENTS

| | | | |
|---|---|---|---|
| 2,592,237 | 1/1950 | Bradley | 92/13.7 |
| 4,141,676 | 2/1979 | Jannen et al. | 417/539 |
| 4,245,966 | 1/1981 | Riffe | 417/539 |
| 4,302,163 | 11/1981 | Hope et al. | 417/539 |

*Primary Examiner*—Carlton R. Croyle
*Assistant Examiner*—David Scheuermann
*Attorney, Agent, or Firm*—Haugen and Nikolai

[57] ABSTRACT

A variable stroke positive displacement piston pump in which the effective eccentricity of the crankshaft controlling the stroke is adjustable by means of a worm-/worm gear combination driving a hub to which eccentric rings are keyed.

4 Claims, 4 Drawing Sheets

VARIABLE STROKE POSITIVE DISPLACEMENT PUMP

BACKGROUND OF THE INVENTION

I. Field of the Invention

This invention relates generally to fluid pumps, and more particularly to an improved piston-type positive displacement pump in which the stroke length of the piston or pistons utilized in the pump can be manually adjusted to vary the pump output for a given drive speed.

II. Discussion of the Prior Art

In certain fluid handling applications, it is often desirable to introduce a precise, predetermined quantity of a chemical into a fluid stream so that the chemical will be dispensed in a desired ratio with a carrier fluid. For example, in agricultural spraying applications, liquid herbicides or pesticides may be introduced into a stream of water before the water is dispensed through a spray boom onto the field. In another unrelated application, that of fighting fires, if a small quantity of a chemical surfactant is introduced into the high pressure water stream, a foam is created which is particularly effective in extinguishing certain types of fires.

It is known in the art that a positive displacement pump can be used to effectively meter into a carrier stream a precise, measured quantity of a chemical additive. A typical positive displacement pump will include one or more pistons which are arranged to move in reciprocating fashion within a cylindrical chamber by means of a conventional crankshaft and connecting rod assemblage. On each suction stroke of a piston, a predetermined quantity of the chemical additive will be drawn into its cylindrical chamber and, during the pressure stroke, that quantity will be ejected into the carrier stream. The flow rate of the chemical additive is, of course, a function of the speed at which the pump's shaft is driven as well as the stroke volume of each piston.

In order for a given pump to be able to dispense precise quantities of a chemical into a fluid stream, it is also desirable to be able to manually adjust the piston's stroke. It is desirable that this be done without having to disassemble the pump to alter the eccentric or to substitute pistons and/or connecting rods of differing dimensions.

The John Blue Company of Huntsville, Ala., has manufactured and sold a variable stroke, positive displacement pump in which the eccentricity of the pump's crankshaft can be adjusted by rotating an arm from a location exterior to the pump's crankcase. The mechanical design whereby this is accomplished is set out in a publication entitled "Instruction Manual N-Serve Pump & Carriage Assembly" available from the John Blue Company and those desiring more information on that specific implementation is referred to that publication. Suffice it to say, this prior art pump and especially the stroke adjustment mechanism used therein, is relatively complex in terms of the number of parts required. Moreover, to adjust the stroke length, it is first necessary to remove a locking screw and nut combination which normally holds the stroke-setting arm fixed relative to a toothed-flange which is keyed to a spacer member and which, in turn, is coupled to eccentric rings disposed between the pump's shaft eccentrics and its connecting rods. Once the locking screw is removed, the stroke-setting arm can be turned independent of the flange and with it the eccentric rings. Once the locking screw is loosened, the earlier setting is disturbed and lost. Then when the arm is repositioned at a new setting, it is difficult to retain that setting while again reassembling the locking screw and nut combination.

SUMMARY OF THE INVENTION

In accordance with the present invention, the foregoing disadvantages of the prior art variable stroke positive displacement pump are overcome by providing an improved mechanism for allowing adjustment at the eccentricity of the crankshaft to which the pump's piston(s) are joined from a location exterior to the crankshaft. Specifically, a worm gear is affixed to the crankshaft at a location exterior to the crankcase and the worm gear surrounding the shaft cooperates with a worm mounted in a worm carrier. This worm carrier is, in turn, joined to a hub member having a cylindrical sleeve surrounding the drive shaft and a radially extending flange on one end thereof. This hub member is journaled in suitable bearings in the crankcase housing. The worm carrier is fixedly coupled to the sleeve portion of the hub member.

Depending upon the number of pistons in the pump in question, the crankshaft includes a corresponding number of eccentric circular lobes and surrounding each lobe is an eccentric ring. Means are provided for coupling the flange portion of the hub member to each of the eccentric rings so that when the worm is turned while the crankshaft is held fixed, the hub will be rotated about the shaft as an axis and, in doing so, the key mechanism will simultaneously reposition the eccentric rings.

Each eccentric lobe on the crankshaft has associated with it a connecting rod for coupling the shaft to a reciprocating piston. By being able to rotate the eccentric rings, the stroke of the pistons are simultaneously adjusted.

The foregoing features and advantages of the invention will become apparent to those skilled in the art from the following detailed description of the preferred embodiment, especially when considered in conjunction with the accompanying in which like numerals in the several views refer to corresponding parts.

DESCRIPTION OF THE PREFERRED EMBODIMENT

Figure 1:
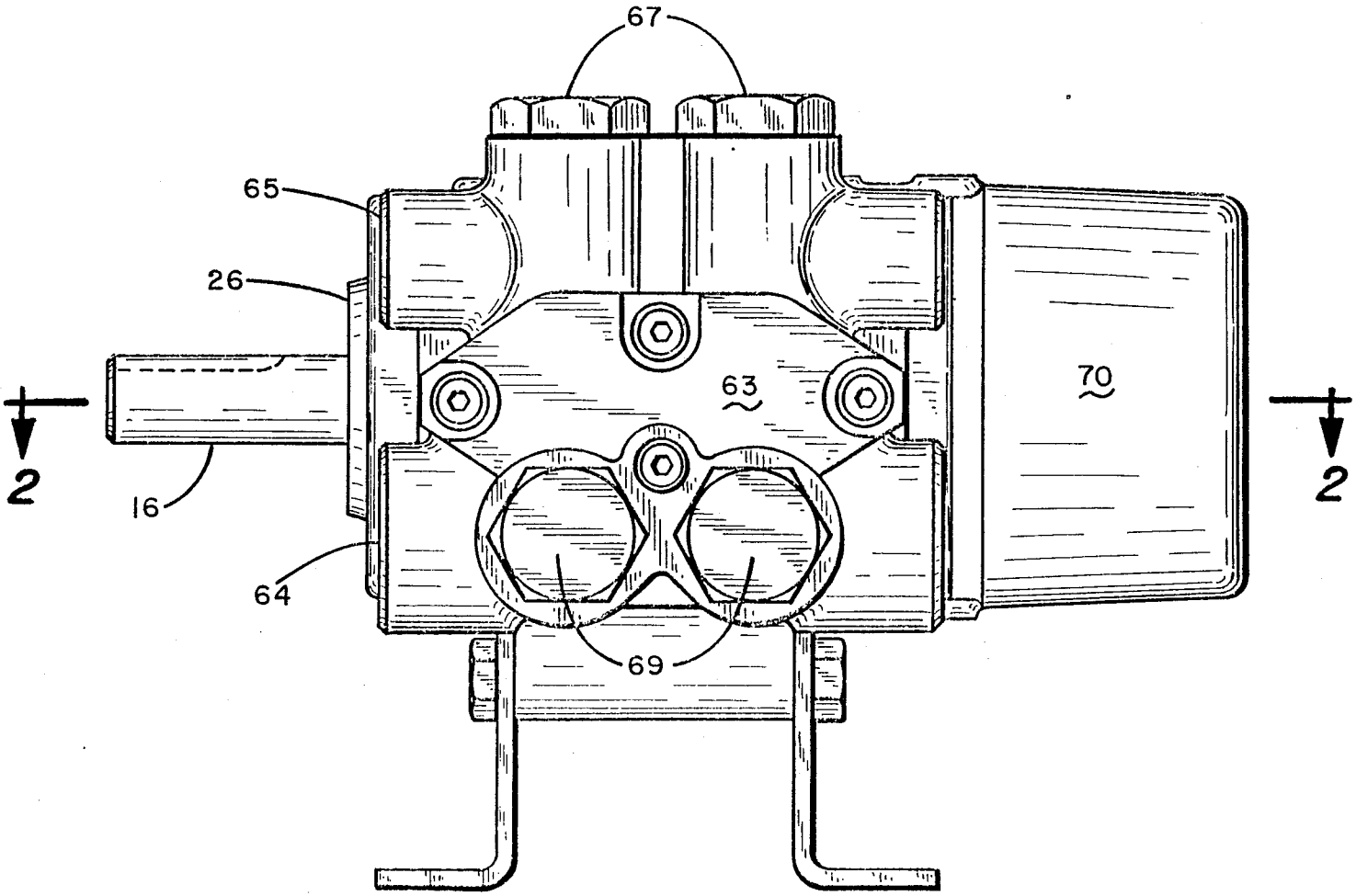
FIG. 1 is a side view of a pump incorporating the present invention.
Figure 2:
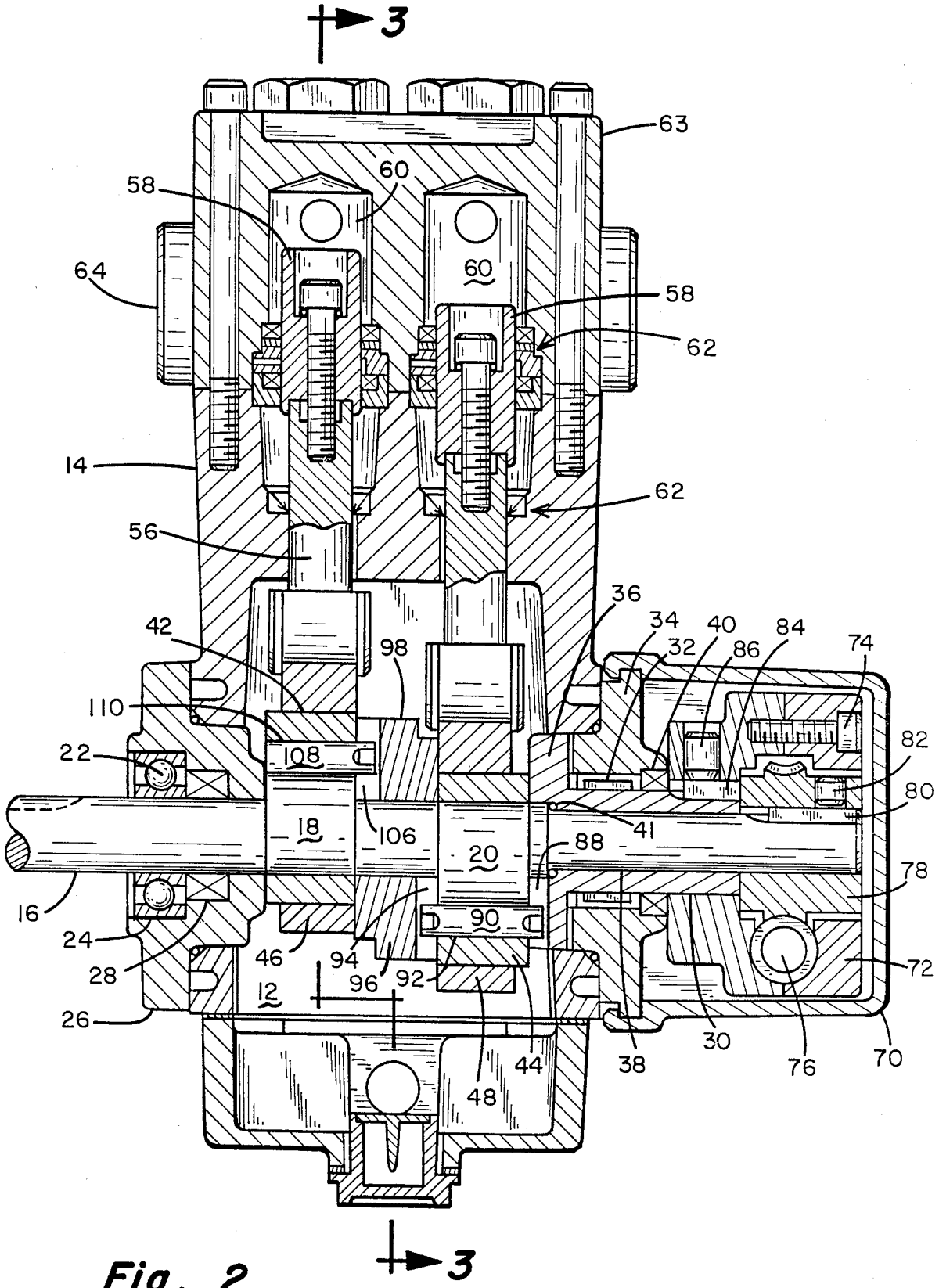
FIG. 2 is a cross-sectional view taken along the line 2—2 in FIG. 1.

Referring to FIGS. 1 and 2, there is shown a side elevation and a cross-sectional view of a positive displacement pump. The pump is indicated generally by numeral 10, and strictly for the purposes of illustration, is shown as a two-cylinder pump. It should be understood, however, that the principles of the present invention can be applied to a pump with one, two or more cylinders, without departing from the spirit and scope thereof.

The pump includes a crankcase 12 formed in the base portion of a cylinder block 14. Journaled for rotation in the crankcase 12 is the pump's shaft 16 which is adapted to be driven by a motor or other type of prime mover (not shown). For a two-cylinder pump, the shaft 16 includes first and second eccentric lobes 18 and 20 which are offset from one another by 180°. (For a three-cylinder pump, the circular lobes integrally formed on the crankshaft 16 would be offset 120°.)

With continued reference to FIG. 2, the left end portion of the shaft 16 is journaled in a set of ballbearings 22 contained with a counterbore 24 of the left end plate 26 which is bolted to the cylinder block 14. An oil seal 28 is provided to inhibit the loss of lubricating oil contained within the crankcase 12.

The rightmost end of the shaft 16 when viewed as in FIG. 2 is journaled for rotation within a hub member 30 with this hub itself being, in turn, supported by means of roller bearings 32 within a right end plate 34 also bolted to the face of the cylinder block 14. The hub member 30 includes a circular flange 36 formed integrally with the tubular sleeve portion thereof. The flange is concentric with the central bore 38 of the hub 30 through which the shaft 16 extends. Again, an oil seal 40 and an O-ring 41 are included to prevent the egress of lubricating oil from the crankcase 12.

Figure 3:
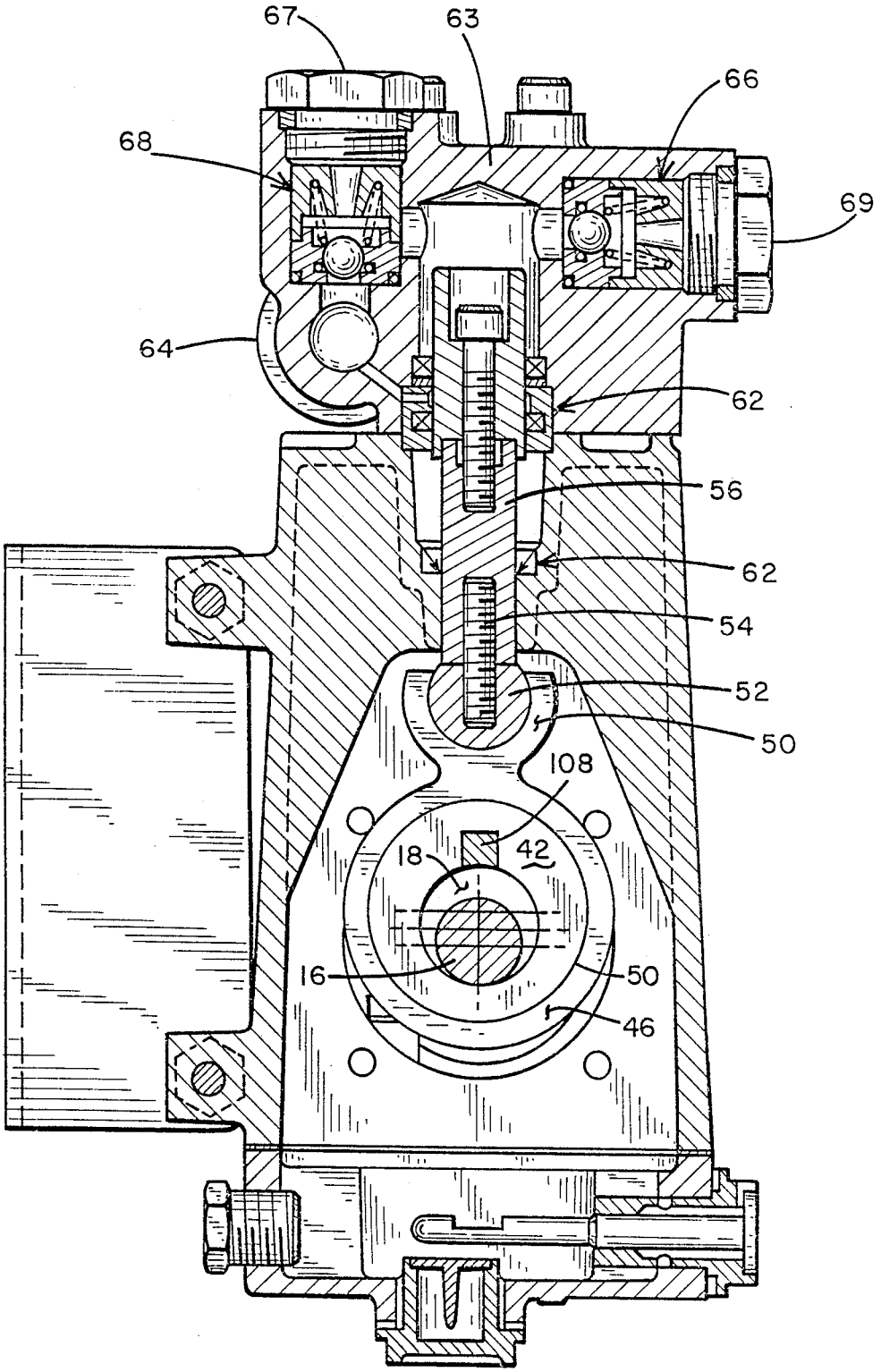
FIG. 3 is a cross-sectional view taken along the line 3—3 in FIG. 1.

Surrounding each of the circular lobes 18 and 20 on the crankshaft 16 are eccentric rings 42 and 44. Extending about the eccentric rings are connecting rods 46 and 48 which, as can best be seen in the cross-sectional view of FIG. 3, include a circular bore 50 which is only slightly larger in diameter than the outer periphery of the eccentric ring 42. Hence, the eccentric ring 42 is free to rotate about the circular lobe 18.

The connecting rods 46 and 48 include a yoke portion 50 (FIG. 3) which cooperates with a floating wrist pin 52 in a manner more fully described in applicant's earlier U.S. Pat. No. 4,381,179, which is assigned to the assignee of the instant application. The floating wrist pin receives a threaded fastener 54 used to join the wrist pin to a cylindrical plunger member 56 to which the pump's pistons 58 are attached. The pistons 58 are arranged to move in reciprocating fashion within cylindrical bores 60 formed within the cylinder block 14. Suitable guides and seals indicated generally by numeral 62 are provided for precluding crankcase lubrication from flowing into the stream of fluid being pumped and for preventing that fluid from entering and contaminating the lubricating oil within the crankcase 12. The seals and guide members 62 may be arranged as is described in applicant's U.S. Pat. No. 4,242,062.

In that the present invention is primarily concerned with the manner in which the stroke length of the pistons 58 can be adjusted, it is not believed necessary to describe in detail the portions of the pump structure except those utilized to effect the adjustment in stroke length. Suffice it to say, cylinder block 14 has secured to it a cylinder head member 63 which 60 in fluid communication with the pump's inlet port 64 and outlet port 65. Inlet and outlet poppet valve assemblies 66 and 68 are included in the cylinder head 63 between the inlet and outlet ports, respectively, such that on the suction stroke of a given piston, the inlet valve will open to allow the fluid to be pumped to enter the cylinder while the outlet valve for that cylinder remains closed. On the pressure stroke, however, the poppet valve associated with the inlet port will close while that associated with the outlet port opens. These valves are held in position by removable plugs 67 and 69 which allow ready removal and replacement as the valves become worn.

Referring again to FIG. 2, a removable protective cap 70 is arranged to snap onto the right end plate 34 and contained within the cover or cap 70 is a two-piece worm carrier 72 which, when bolted together, as at 74, supports a worm 76 for rotation therein. The gear surface on the worm 76 meshes with a worm gear 78 which is secured to the crankshaft 16 by means of a key 80 held in place by a set screw 82.

The worm carrier 72 is likewise secured to the sleeve portion of the hub member 30 by means of a key 84 which is held in place by a set screw 86. Thus, when the worm 76 is manually turned by an appropriate hand tool, such as a screwdriver or allen wrench, while the shaft 16 is held fixed, the worm carrier 72 will orbit about the worm gear 78 and, in doing so, will rotate the hub member 30 about the shaft 16.

As can be seen in FIG. 2, there is formed in the internal face of the flange 36 of the hub 30, a radial slot 88 into which is fitted one end of a cylindrical, double-ended pin member 90. Pin member 90 has two milled-flat ends. The cylindrical center portion of the pin member 90 fits through a notch 92 formed in the eccentric ring 44, as perhaps best seen in the blown-apart view of FIG. 4.

Figure 4:
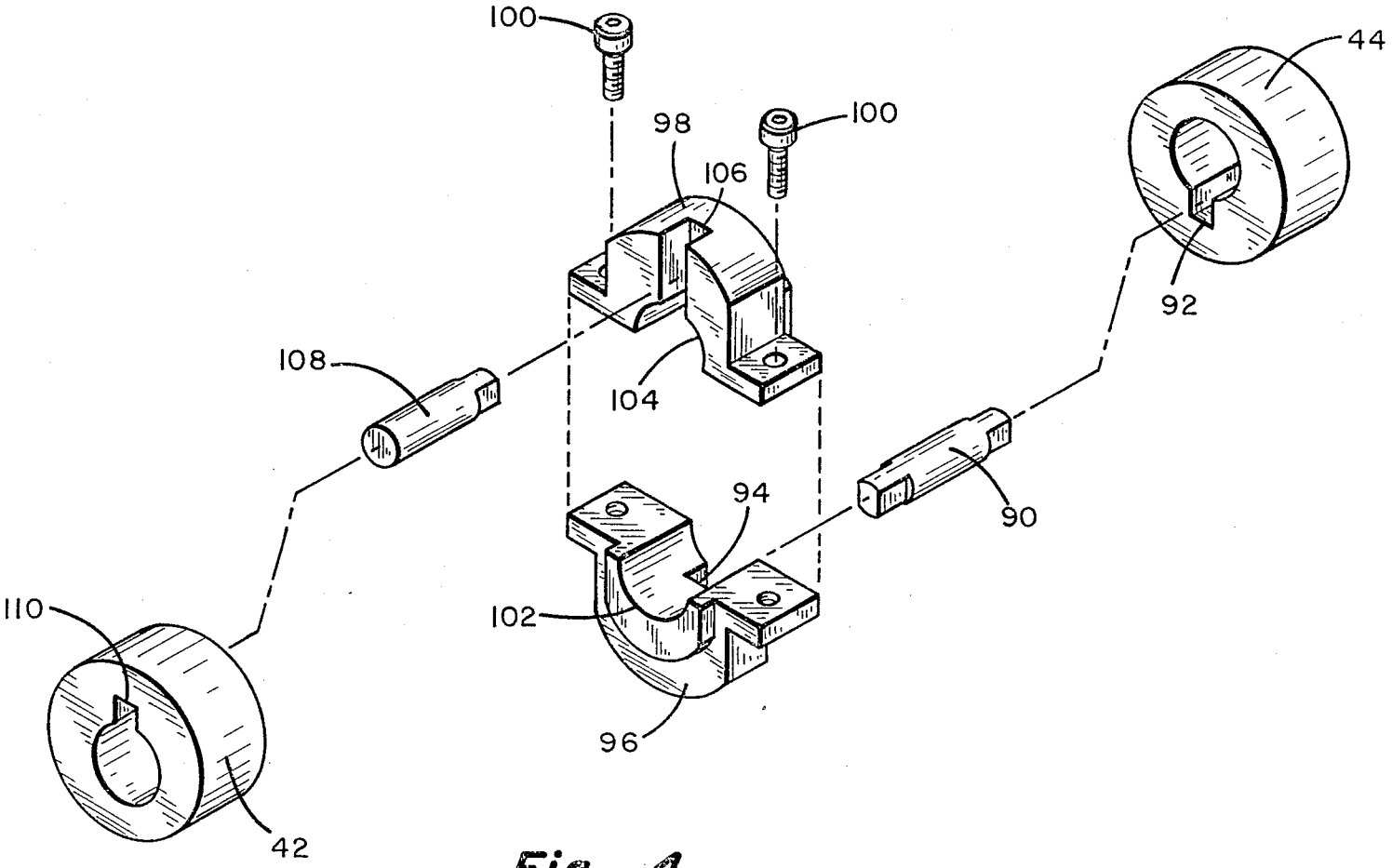
FIG. 4 is a blown-apart perspective view of the structures used to key the pump's eccentrics to a worm gear adjustment mechanism.

The other flattened end of the double-ended pin member 90 is arranged to ride in a radial slot 94 which is cut into a side surface of a first yoke member 96. A similar yoke member 98 is adapted to be attached to the yoke member 96 by means of fasteners 100 with the portion of the shaft 16 intermediate the circular lobes 18 and 20 fitting within the cooperating semicircular grooves 104. Because a predetermined clearance is provided, the joined yoke members 96 and 98 can rotate freely about the shaft 16 as its center. The yoke halves 96 and 98 are similar pieces with one being drilled and the other being threaded to accommodate the fasteners 100 as shown in FIG. 4.

The radial notch 106 formed in the yoke half 98 is dimensioned to receive the flat end of the pin member 108. The cylindrical portion of the pin 108 is dimensioned to fit within a radial notch 110 which projects inwardly from the circular central lobe-receiving opening formed in the eccentric ring 42.

From the foregoing description, it is apparent that as the hub member 30 is rotated due to rotation of the worm 76, the engagement of the radial notch 88 with the double-ended pin 90 will result in the eccentric 44 also being rotated as round portion of the pin 90 rides in the slot 88. Likewise, the joined yoke members 96 and 98 will be rotated about the shaft 16 as the other flattened end of the double-ended pin 90 rides in the slot 94 formed in the yoke member 96. Because of the presence of the pin 108 in the slot 106 formed in the other yoke member 98, a rotational force will also be applied to the eccentric ring 42 causing it to turn an equal amount as the eccentric ring 44. In this fashion, the length of the stroke of the pistons 58 may be changed by equal amounts, with the eccentricity of the rings 42 and 44 either adding to or detracting from the eccentricity of the circular lobes 18 and 20, depending upon the direction of rotation of the worm 76. The keyways 92 and 110 should be located on the imaginary line passing through the centers of both the shafts circular eccentric lobe and the eccentric ring surrounding it. By locating the keyways on this line and tangent to the shaft lobe opening, a "zero" total eccentricity setting can be achieved while conserving on the overall diameter of the crankcase needed to house the assembly.

It can be seen, then, that with the pump stopped and the cap or cover 70 removed, a simple rotation of the worm 76 will cause the effective eccentricity of the crankshaft to be changed with great precision comparable to a micrometer, resulting in an adjustment of the extent to which the pistons 58 are displaced in their reciprocating motion when the shaft 16 is again driven by the pump's prime mover. The stroke length is thus continuously adjustable from a minimum of zero to a pre-designed maximum.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to equipment details and operating procedures, can be accomplished without departing from the scope of the invention itself.

What is claimed is:

1. In a positive displacement piston pump of the type including a crankcase, a shaft journaled for rotation in said crankcase, said shaft including a circular eccentric lobe for each piston included in said pump, a cylinder block attached to said crankcase, said cylinder block including a cylindrical bore for each piston of said pump, a cylinder head attached to said cylinder block, said cylinder head including a fluid inlet port and a fluid outlet port in fluid communication with each cylindrical bore, inlet valve means and outlet valve means operatively disposed between each cylindrical bore and said inlet and outlet ports, respectively, and in connecting rod means operatively coupled between each circular eccentric lobe and an associated piston for imparting reciprocating movement to said piston, apparatus for allowing adjustment of the extent of said reciprocating movement of each piston comprising:

(a) an eccentric ring surrounding and rotatable about each circular eccentric lobe on said shaft, said eccentric rings including a keyway extending through the thickness dimension thereof and being operatively coupled to said connecting rod means; and (b) means for simultaneously rotating each of said eccentric rings relative to said circular eccentric lobes by equal amounts, said means including (i) a worm gear secured to said shaft exterior to said crankcase, (ii) a hub member having a stem portion with a longitudinal bore in which said shaft is journaled, said hub member, in turn, being journaled for rotation in said crankcase and including a radial flange portion at one end of said stem portion positioned internal of said crankcase and said hub member having a radial slot formed in said flange portion, (iii) a worm carrier affixed to said hub and surrounding said worm gear (iv) a worm journaled for rotation in said worm carrier and meshing with said worm gear, and (v) pin means cooperating with said keyway in said eccentric rings and received in said radial slot on said flange portion whereby rotation of said worm in said worm carrier while said shaft is held fast rotates said hub and each eccentric ring relative to each circular eccentric lobe.

2. The pump as in claim 1 wherein said shaft includes at least two of said circular eccentric lobes longitudinally spaced along the length of said shaft and internal to said crank case.

3. The pump as in claim 2 wherein said pin means includes:

(a) first and second yoke members fastened together about the portion of said shaft intermediate said two circular lobes and having a predetermined clearance fit relative to said shaft portion, said first and second yoke members each including a radial slot formed in a face surface thereof;

(b) a first pin member inserted into said keyway of one eccentric ring with a first portion of said first pin member fitting into said radial slot in said flange portion of said hub and a second portion of said first pin member fitting into said radial slot formed in said first yoke member; and (c) a second pin member fitted within said keyway of the other eccentric ring with a portion of the second pin member engaging said radial slot formed in said second yoke member.

4. The pump as in claim 1 wherein said keyway in each of said eccentric rings is tangent to the opening formed therethrough and aligned with an imaginary line passing through the center of said circular eccentric lobe on said shaft and the center of said opening formed through said eccentric ring when said eccentric ring surrounds said circular eccentric lobe.

* * * * *